US008850645B1

(12) United States Patent
Jackson et al.

(10) Patent No.: US 8,850,645 B1
(45) Date of Patent: Oct. 7, 2014

(54) THERAPEUTIC SEAT CUSHION

(75) Inventors: Trudy Jackson, Colorado Springs, CO (US); Shirley Emerson, Colorado Springs, CO (US)

(73) Assignee: A Bright Idea Custom Laser Designs LLC, Colorado Springs, CO (US)

( * ) Notice: Subject to any disclaimer, the term of this patent is extended or adjusted under 35 U.S.C. 154(b) by 138 days.

(21) Appl. No.: 13/187,958

(22) Filed: Jul. 21, 2011

Related U.S. Application Data

(60) Provisional application No. 61/400,035, filed on Jul. 21, 2010.

(51) Int. Cl.
*B68G 5/00* (2006.01)

(52) U.S. Cl.
USPC ..... 5/654; 5/655.9; 297/452.23

(58) Field of Classification Search
USPC ..... 5/653, 655, 657, 652, 425, 654, 656, 5/655.9; 297/452.23
See application file for complete search history.

(56) References Cited

U.S. PATENT DOCUMENTS

| | | | | |
|---|---|---|---|---|
| 4,824,174 | A | 4/1989 | Dunn, Sr. | |
| 5,163,737 | A | 11/1992 | Navach et al. | |
| 5,286,089 | A | 2/1994 | Goldman | |
| 5,611,098 | A * | 3/1997 | Skibik | 5/653 |
| 5,829,081 | A | 11/1998 | Pearce | |
| 5,855,415 | A | 1/1999 | Lilley, Jr. | |
| 6,202,234 | B1 | 3/2001 | Henderson | |
| 7,549,183 | B2 * | 6/2009 | Dockendorf et al. | 5/655 |
| 7,856,688 | B2 * | 12/2010 | Dockendorf | 5/655 |
| 2008/0216245 | A1 * | 9/2008 | Liners | 5/654 |

* cited by examiner

*Primary Examiner* — Peter M Cuomo
*Assistant Examiner* — Brittany Wilson
(74) *Attorney, Agent, or Firm* — BL Speer & Associates; Brenda L. Speer

(57) ABSTRACT

The present invention is a therapeutic seat cushion to alleviate pain when sitting such as tailbone, sit bone, pudendal nerve, post operative, or pelvic pain, or after childbirth or any other situation that may cause a user pain when sitting. The therapeutic seat cushion is adjustable and portable to suit a user's needs. The therapeutic seat cushion comprises a base and at least two cushions that are removably attachable to the base and which may be adjusted in any configuration upon the base to provide a user customized pain relief with stable, unmovable support. The therapeutic seat cushion has carry handles and may be folded in half to join the handles with a closure for easy portability.

3 Claims, 8 Drawing Sheets

THERAPEUTIC SEAT CUSHION

CROSS-REFERENCE TO RELATED APPLICATION

This application claims the benefit of U.S. Provisional Application No. 61/400,035 filed Jul. 21, 2010.

BACKGROUND OF THE INVENTION

1. Field of the Invention

The present invention relates to a therapeutic seat cushion.

2. Description of Related Art Including Information Disclosed Under 37 CFR 1.97 and 37 CFR 1.98

Everyone needs to sit at least a few times during the day: to eat, drive, take a plane trip, work, go to movies or to concerts and many other daily activities. People who have pain when sitting find it difficult to do these common everyday activities. People have pain due to different reasons, to different degrees and in different places. Various therapeutic seat cushions are known. Examples of these follow.

U.S. Pat. No. 4,824,174 issued Apr. 25, 1989, by Dunn, Sr., for Seating Device discloses a seating device for alleviating backache, in particular coccygeal pain, in which the seating device has a T-shaped opening therein to alleviate stress on the coccyx (along the cross bar of the T-shaped opening) and to allow freer circulation to the genital area of a seated person (along the longitudinal stem of the T-shaped opening).

U.S. Pat. No. 5,163,737 issued Nov. 17, 1992, by Navach et al. for Cushion discloses a cushion, in particular for a sedentary person, with a contoured base with a layer of resilient cushion foam thereover; wherein the cushion is shaped to accommodate the buttocks of a seated person in a clasped position and has recesses therein under each of the ischia, trochanters and sciatic nerves of the seated person to limit local pressure in those anatomical areas.

U.S. Pat. No. 5,286,089 issued Feb. 15, 1994, by Goldman for Seat Cushion for Alleviation of Perineal and Rectal Discomfort discloses a unitary foam seat cushion statically configured and arranged to eliminate contact pressure on the rectal, perineal and genital regions of a person seated on the seat cushion without subjecting the perineal region to substantial stress or tension. The cushion includes a base and two upwardly projecting elongate support members positioned in parallel spaced apart relationship for support of the ischia and thighs, and located between the support members is a channel to form a void that prevents exertion of contact pressure on the rectal, perineal and genital areas.

U.S. Pat. No. 5,829,081 issued Nov. 3, 1998, by Pearce for Cushion Device Formed from Separate Reshapable Cells discloses a cushion that includes a base and numerous bladders locatable on the base; wherein each bladder contains a quantity of filler insufficient to completely fill the bladder and each bladder has a loose or elastomeric skin to accommodate its conforming to the shape of an object, such as a human, to be supported by the cushion; further wherein the top surface of each bladder acts as a hammock when supporting a cushioned object, and the bladders interact with each other to accommodate protuberances and crevices of the cushioned object.

U.S. Pat. No. 5,855,415 issued Jan. 5, 1999, by Lilley, Jr., for Portable Seat Cushion Having Pressure-Reducing Properties discloses a portable seat cushion designed for seating comfort of a user, but not necessarily therapeutic comfort, and using low-to-medium density cellular elastomer foams with pressure-reducing properties to maximize user comfort; wherein the foam layers are mechanically laminated to produce a statically configured, multi-layer composite.

U.S. Pat. No. 6,202,234 issued Mar. 20, 2001, by Henderson for Therapeutic Pillow discloses a therapeutic pillow for supporting the tail bone of a user and for cradling the buttocks of the user to assure that support for the tail bone of the user is held in place; wherein the pillow comprises a base, a support and a pair of bolsters; further wherein the pair of bolsters extend axially along the base, straddle the support, cradle the buttocks of the user and assure that the support is held in place under the tail bone of the user by minimizing lateral movement of the user.

In the field of therapeutic seat cushions, there is a lack of variety, adjustability and affordability. Therefore, it is difficult to find a cushion that meets a user's particular needs. Currently, there are a number of therapeutic seat cushions on the market for people who have pain when sitting. Some of these therapeutic seat cushions attempt to provide relief through one standard design, but these solutions fail to meet the needs of users, because these therapeutic seat cushions are a one-size-fits-all design. Other solutions attempt to provide different materials or shapes, but lack the ability to allow the user to adjust the therapeutic seat cushion to a position that meets the user's needs. Additionally, prior art solutions provide a general use therapeutic seat cushion that is both cumbersome and difficult to transport, making travel a hassle.

BRIEF SUMMARY OF THE INVENTION

The present invention is a therapeutic seat cushion comprising a base, and at least two cushions; wherein the cushions are removably attachable to and adjustably configurable on the base. The therapeutic seat cushion of the present invention may further comprise handles integral with the base; further wherein the base may be folded and closed. The therapeutic seat cushion of the present invention may further comprise an optional pouch for a heat or cold pack, wherein the pouch is removably attachable to the base.

LIST OF REFERENCE NUMERALS

Figure 1:
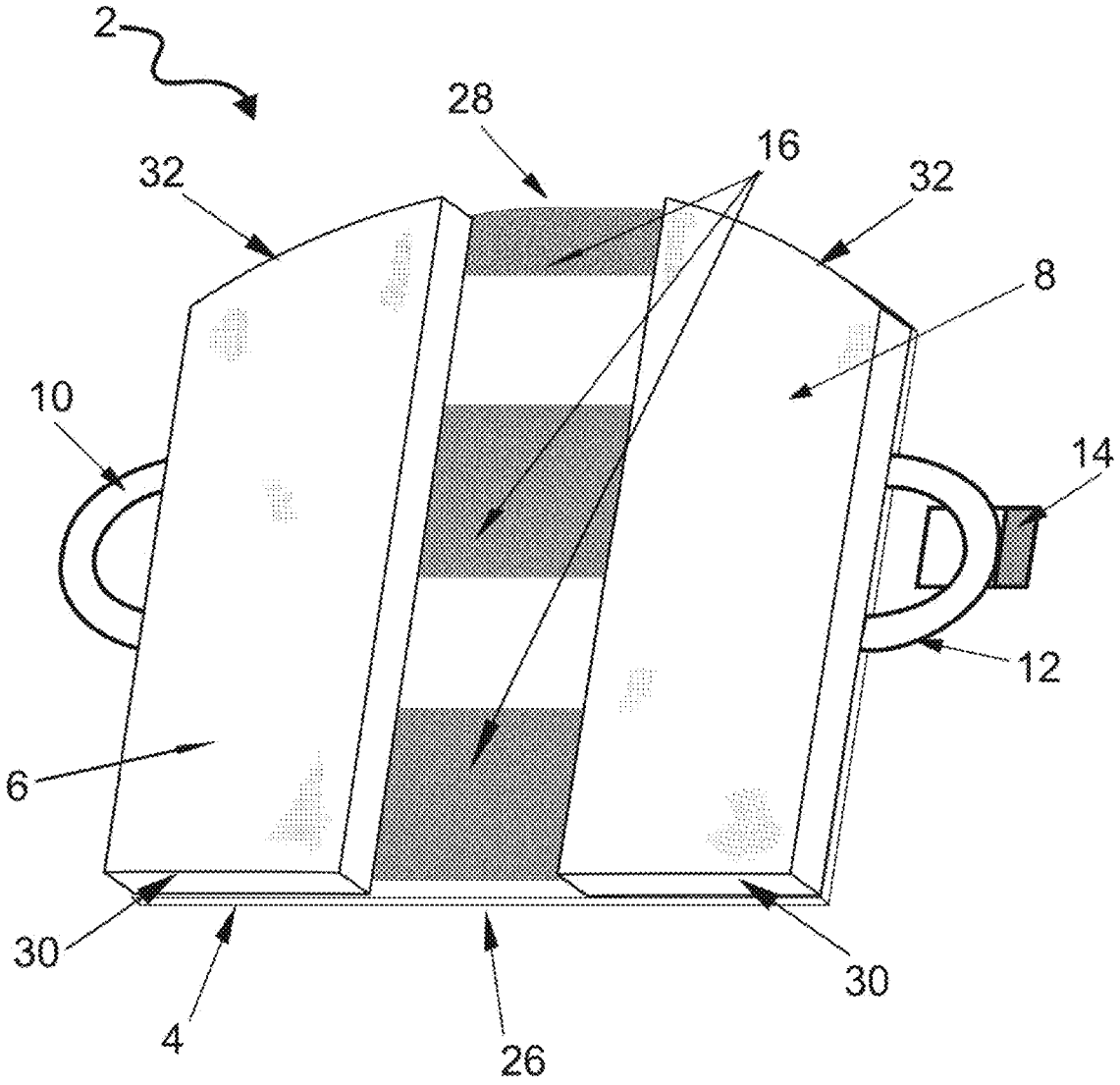
FIG. 1 is a top perspective view of a therapeutic seat cushion of the present invention.

2 therapeutic seat cushion
4 base
6 left cushion

8 right cushion
10 left handle
12 right handle
14 handle closure
16 base fastener
18 cushion fastener
20 bottom cushion layer
22 middle cushion layer
24 top cushion layer
26 base front
28 base back
30 cushion front
32 cushion back
34 top fabric cover
36 top batting layer
38 bottom batting layer
40 bottom fabric cover
42 pouch
44 pouch backside
46 pouch closure
48 pouch fastener
50 pouch opening
52 zipper closure

DETAILED DESCRIPTION OF THE INVENTION

It would be desirable to have a cushion available to people who suffer from pain when sitting, due to injury, occupation or medical condition, which would provide for each person's individual needs. The therapeutic seat cushion of the present invention meets these needs through a choice of firmness levels for comfort and complete adjustability to support the proper body areas according to a user's needs, creating the best possible relief from pain for the user. Furthermore, the therapeutic seat cushion of the present invention is readily portable making it easy to carry or pack for travel. Currently, there does not exist an adjustable and easily portable therapeutic seat cushion on the market today that meets these objectives.

The present invention advantageously fills the aforementioned deficiencies by providing an adjustable and easily portable therapeutic seat cushion to help people who have pain when sitting. The therapeutic seat cushion of the present invention provides an ability to customize the therapeutic seat cushion to the user's need through a variety of firmness levels and position-adjustable cushions to support and provide relief for a user's painful areas.

The therapeutic seat cushion of the present invention is an adjustable cushion to alleviate pain when sitting and provides: (1) different levels of firmness and size to suit a user's needs; (2) removably attachable and position adjustable cushions that may be arranged in any configuration to support a user in a comfortable sitting position while providing relief from pain; and (3) an easily convenient and transportable therapeutic seat cushion for use in any environment.

With reference to FIG. 1, a therapeutic seat cushion 2 of the present invention allows a user to create a best support position to suit the user's particular needs. The therapeutic seat cushion 2 is comprised of three main elements, a base 4 and at least two removably attachable and position adjustable cushions, a left cushion 6 and a right cushion 8. Integral with the base 4 are carry handles, a left handle 10 and a right handle 12 which may be joined or mated together for ease of carrying by handle closure 14.

Figure 2:
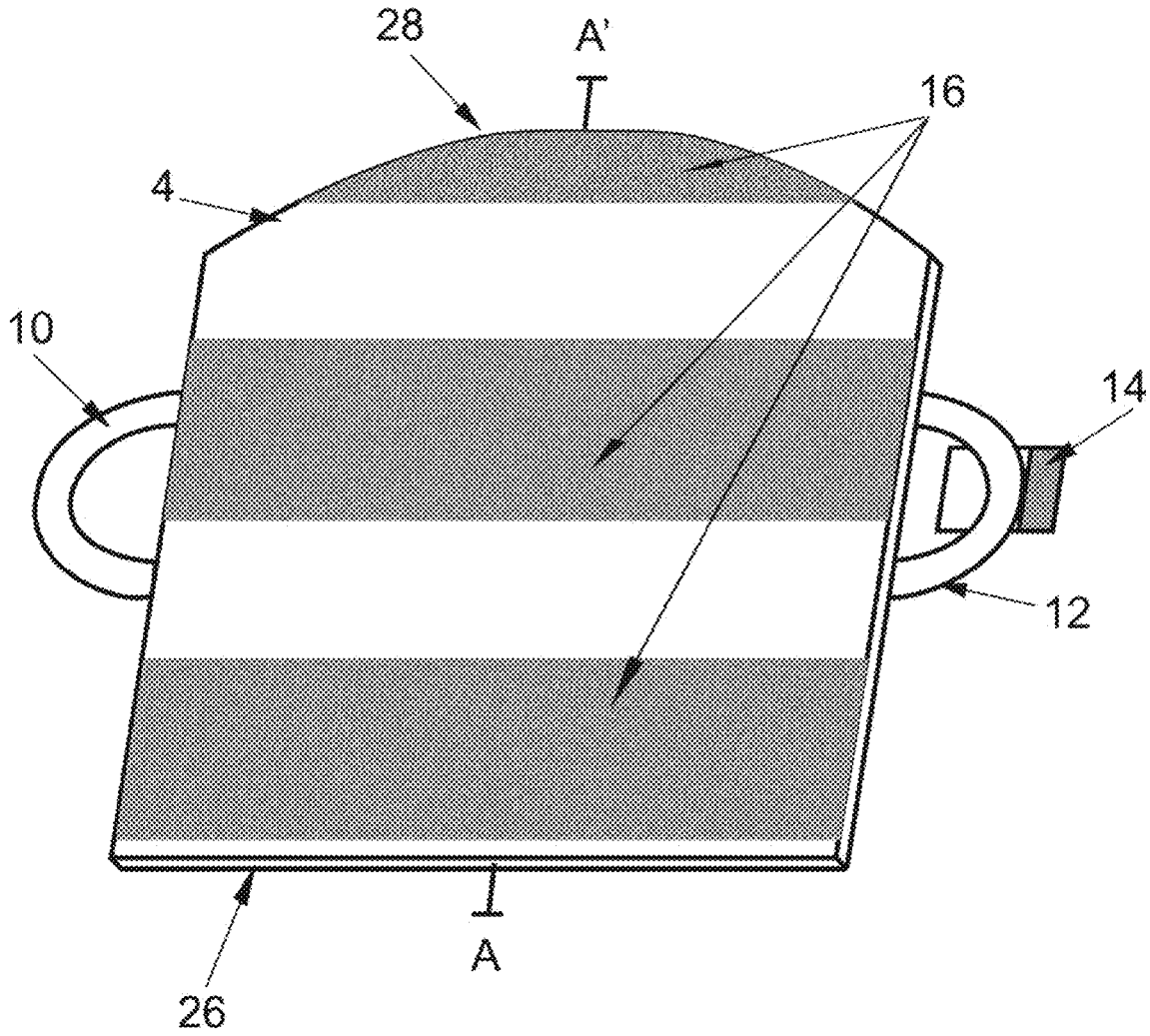
FIG. 2 is a top perspective view of a base of the therapeutic seat cushion of the present invention.

With reference to FIG. 2, to construct the therapeutic seat cushion 2, first, a firm, flat base 4 is made of layers of thick interfacing between a closed, fabric cover. The interfacing preferably is bonded to the fabric cover by means of a heat and bond glue. The base 4 is shaped essentially as a modified square with an outward rounded side at the base back 28. The base front 26 is a straight edge. Attached by any suitable means, such as sewing or gluing, to a top side of the base 4 in a preferred perpendicular relation to line A-A', are preferably wide strips of base fastener 16, preferably three strips as shown, of a loop portion of a hook and loop tape. If three strips of base fastener 16 are used, then preferably as shown in FIG. 2, (a) an approximately 4.0" strip of base fastener 16 is placed along a base front 26 edge, (b) approximately 3.0" apart from the base front 26 edge strip of base fastener 16, another approximately 4.0" strip of base fastener 16 is placed across a center portion of the base 4, and (c) approximately 3.0" apart from the center portion strip of base fastener 16, another approximately 2.0" strip of base fastener 16 is placed along base back 28 edge, wherein a back edge of the base fastener 16 mirrors a contoured shape of the base back 28. It is preferred that the loop portion of the hook and loop tape be used for the base fastener 16, because the loop portion typically will not adhere to a user's clothing or catch on other objects. Alternatively, any number of base fastener 16 strips or other geometrically configured portions (for example, circles, squares, etc.) may be used, or the entire base 4 may be covered with base fastener 16 at a user's preference.

Centered on each of a left side edge and a right side edge of the base 4, and preferably sewn into the side seams thereof, are a left handle 10 and right handle 12, respectively. The handles 10, 12 may be approximately 9.0" in length and may comprise a simple loop handle.

The therapeutic seat cushion 2 may be folded along line A-A' and latched at the handles 10, 12 with handle closure 14 for closure and easy portability. When the therapeutic seat cushion 2 is folded along line A-A', the handles 10, 12 will pair and may be mated together with handle closure 14 by any suitable fastener means, such as hook and loop tape as shown in a preferred embodiment, or by means of snaps, hooks and eyes, zippers or the like. Also, when the therapeutic seat cushion 2 is in a folded or closed configuration, the cushions 6, 8 are protected during transportation.

Figure 5:
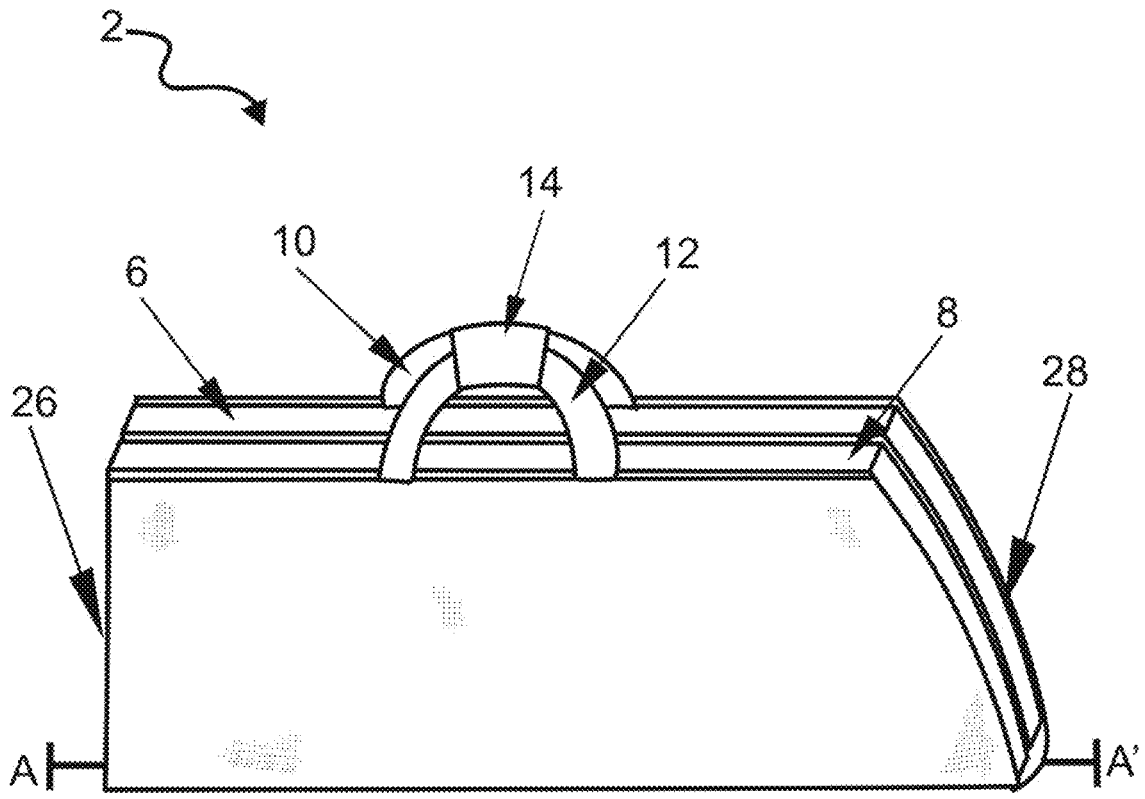
FIG. 5 is side perspective view of the therapeutic seat cushion of the present invention in a closed position.

With reference to FIG. 2 and FIG. 5, the therapeutic seat cushion 2 of the present invention is shown in a folded and closed position. The therapeutic seat cushion 2 is folded in half along line A-A'. Preferably, the therapeutic seat cushion 2 is folded so that the cushions 6, 8 are inside of the base 4; however, alternatively, the therapeutic seat cushion 2 may be folded so that the cushions 6, 8 are outside of the base 4. In an alternative embodiment, a low profile version of the therapeutic seat cushion 2 may be constructed so that in a folded and closed position the therapeutic seat cushion 2 would be approximately 2.5" thick and able to be packed within another container, such as a briefcase or small tote bag.

Figure 3:
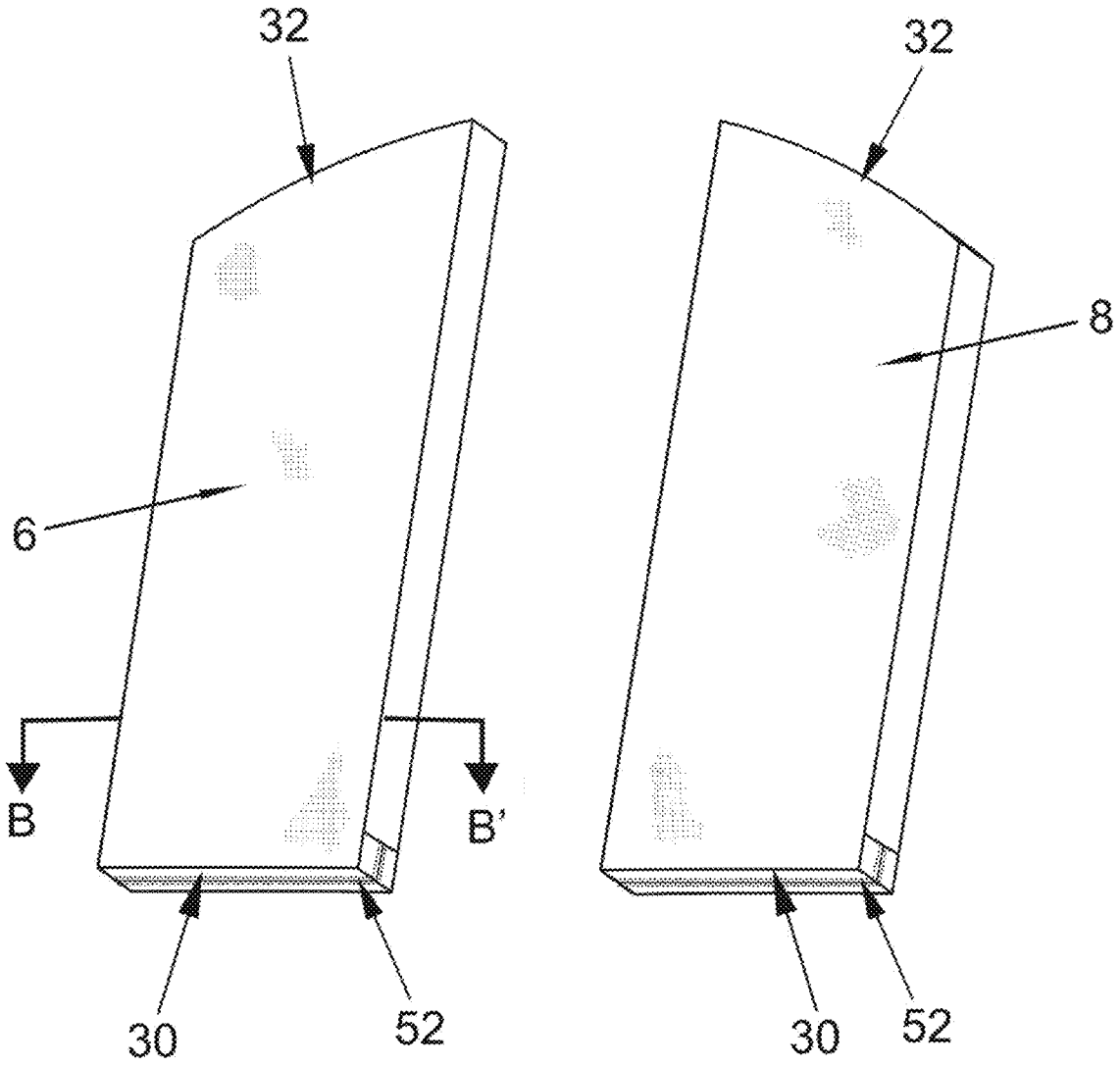
FIG. 3 is top perspective view of a left cushion and a right cushion of the therapeutic seat cushion of the present invention.
Figure 4:
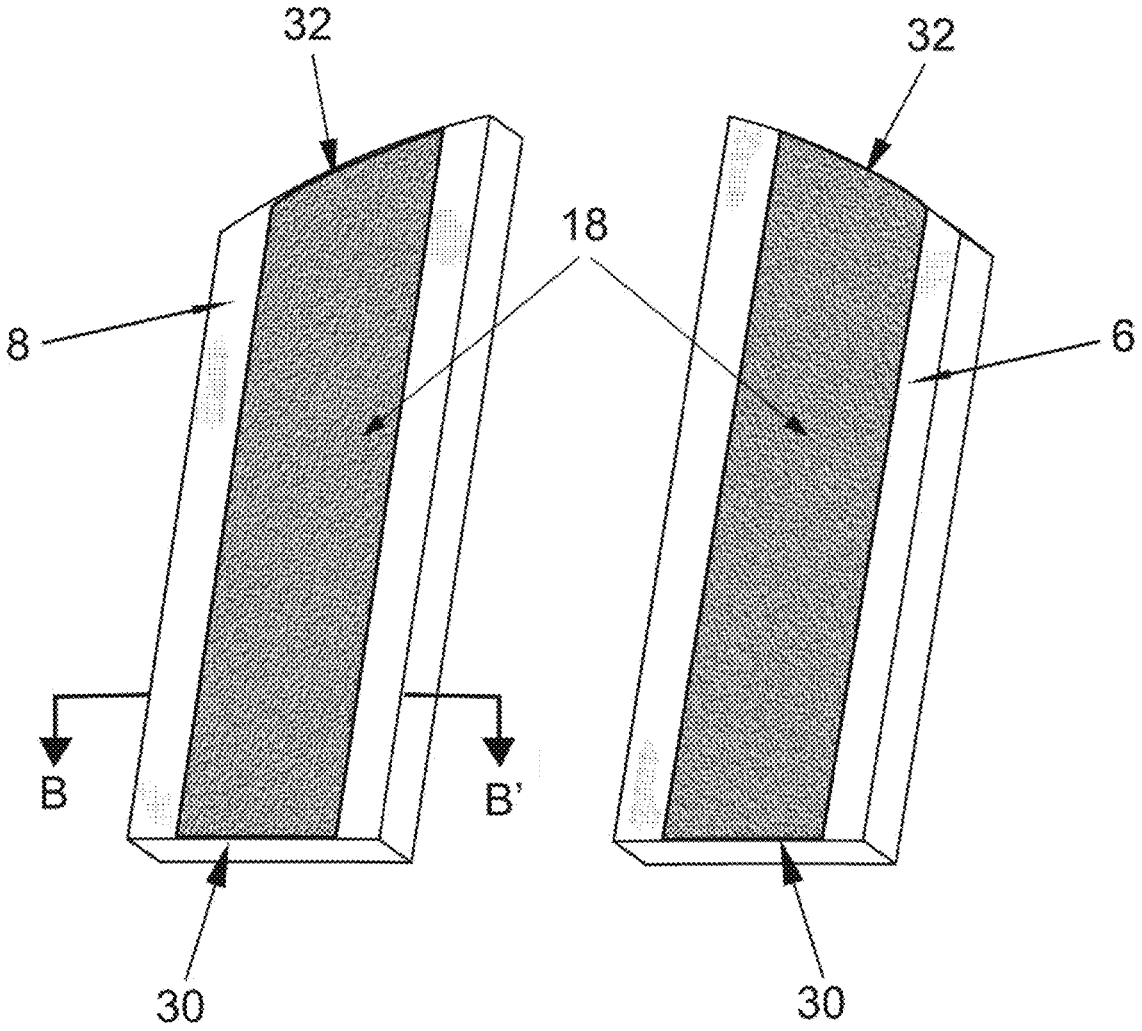
FIG. 4 is bottom perspective view of the left cushion and the right cushion of the therapeutic seat cushion of the present invention.

With reference to FIG. 3, the therapeutic seat cushion 2 further comprises at least a left cushion 6 and a right cushion 8. The left cushion 6 and the right cushion 8 are preferably made to match, in mated relation, the shape of the base 4. With reference to FIG. 1, FIG. 3 and FIG. 4, in a preferred embodiment, a cushion front 30 edge mirrors a shape of a base front 26 edge, and a cushion back 32 edge mirrors a shape of a base back 28 edge. When the left cushion 6 and the right cushion 8 are mated with or removably attached to the base 4, there is an opening or void between the left cushion 6 and the right cushion 8 of preferably approximately 5.0" as shown in FIG. 1. The purpose of the void is to provide an area of the therapeutic seat cushion 2 that does not contact the user's body, for example, an injured tailbone, and, thus, provides the user pain relief when sitting. The width and area of the void may be maximized, minimized or eliminated by adjustable configuration by the user to suit the user's pain relief needs by means of positioning the cushions 6, 8 upon the base 4 in any beneficial, desired configuration.

Figure 6:
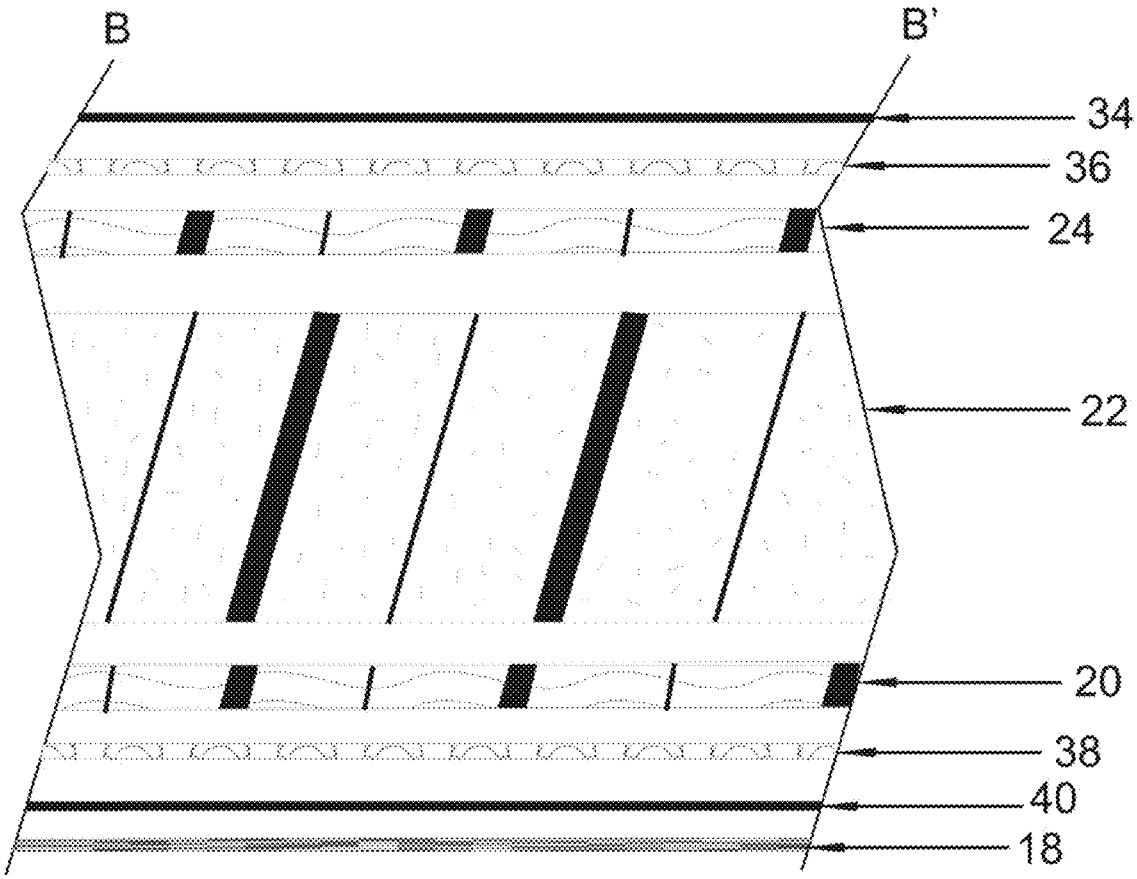
FIG. 6 is a cross-section exploded view of a cushion of the therapeutic seat cushion of the present invention.

With reference to FIG. 6, a cross-section of a left cushion 6 or a right cushion 8 is shown taken along line B-B' of FIG. 3 or FIG. 4. To construct each of the left cushion 6 and the right cushion 8, laminated open and closed cell foams are wrapped in batting and placed in a fabric cover that has a zipper closure 52 on the front edge to form a closable opening within the fabric cover as shown in FIG. 3.

As shown in FIG. 6, a cross-section exploded view of a left cushion 6 or a right cushion 8 depicts a top fabric cover 34, top batting layer 36, top cushion layer 24, middle cushion layer 22, bottom cushion layer 20, bottom batting layer 38, bottom fabric cover 40 and cushion fastener 18. The top cushion layer 24, middle cushion layer 22 and bottom cushion layer 20 may comprise either an open cell or a closed cell foam and the foam may or may not be laminated at a user's preference. The open cell foam may be a high quality, high density upholstery foam and the closed cell foam may be neoprene, also known as polychloroprene, or other similar closed cell foam. Alternatively, top cushion layer 24 and bottom cushion layer 20 may comprise neoprene. Further alternatively, cushions 6, 8 may also be made of any desired materials or configurations, such as a single layer of foam, a gel insert, foam beads or a honeycomb rubber insert, rather than the preferred laminated and layered top cushion layer 24, middle cushion layer 22 and bottom cushion layer 20 configuration.

The type of foam used, the density of each foam layer and the sequence of how the top cushion layer 24, middle cushion layer 22 and bottom cushion layer 20 are layered together and laminated determines the firmness of each left cushion 6 and right cushion 8. Standard firmness levels of soft, medium, firm and extra firm may be used for each of the left cushion 6 and the right cushion 8 in accordance with a user's preference and need.

In a preferred embodiment, each of the cushions 6, 8 are of a shape that mirrors the shape of the base 4 as shown in FIG. 1, FIG. 3 and FIG. 4, and of a size approximately 5.5" wide and approximately 16.0" long at the longer length edge and approximately 13.25" long at the shorter length edge of the cushions 6, 8. With reference to FIG. 3 and FIG. 4, a fabric cover for each of the left cushion 6 and the right cushion 8 is comprised of a top piece, a bottom piece and a side edge piece that interconnects the top piece and the bottom piece along the fabric cover left, right, front and back sides and which side edge piece is approximately equivalent to the height of the cushion 6, 8. As shown in FIG. 3, the front edge, along cushion front 30, of the fabric cover may have a zipper closure 52 that extends across the front edge and up each left and right side edges approximately 2.0" and at each end of the zipper closure 52 there is a pocket to conceal each of a zipper pull and a zipper end from view.

As shown in FIG. 4, cushion fastener 18 preferably extends from a cushion front 30 edge to a cushion back 32 edge. The cushion fastener 18 is preferably approximately 4.0" wide and is comprised of a hook portion of hook and loop tape. By means of the cushion fastener 18 and base fastener 16, the cushions 6, 8 are removably attachable to and position adjustable on the base 4 of the therapeutic seat cushion 2.

In a preferred embodiment, the therapeutic seat cushion 2 is of a medium firmness and is comprised of three layers of laminated foam. With reference to FIG. 6, wherein the foam layers are: (1) a top cushion layer 24 of an approximately 0.25" layer of closed cell foam; (2) a middle cushion layer 22 of an approximately 1.5" layer of high quality upholstery foam; and (3) a bottom cushion layer 20 of an approximately 0.25" layer of closed cell foam.

In another embodiment, the therapeutic seat cushion 2 is of a firm firmness and is comprised of three layers of laminated foam, wherein the foam layers are: (1) a top cushion layer 24 of an approximately 0.25" layer of closed cell foam; (2) a middle cushion layer 22 of an approximately 1.5" layer of high quality upholstery foam; and (3) a bottom cushion layer 20 of an approximately 0.5" layer of closed cell foam.

In yet another embodiment, the therapeutic seat cushion 2 is of an extra firm firmness and is comprised of three layers of laminated foam, wherein the foam layers are: (1) a top cushion layer 24 of an approximately 0.25" layer of closed cell foam; (2) a middle cushion layer 22 of an approximately 1.0" layer of high quality upholstery foam; and (3) a bottom cushion layer 20 of an approximately 1.0" layer of closed cell foam.

In yet another embodiment, a low profile therapeutic seat cushion 2 is comprised of two layers of laminated foam, wherein the foam layers are: (1) a top cushion layer 24 of an approximately 0.5" layer of high quality upholstery foam; and (2) a bottom cushion layer 20 of an approximately 1.0" layer of closed cell foam.

With reference to FIG. 4 and FIG. 6, attached by any suitable means, such as sewing or gluing, to the bottom fabric cover 40 for the cushions 6, 8 is a cushion fastener 18 comprising a preferably approximately 4.0" wide strip of a hook portion of a hook and loop fastener. The cushion fastener preferably extends longitudinally down the length of the cushion 6, 8 from the cushion front 30 edge to the cushion back 32 edge. As previously stated, when the cushions 6, 8 are mated with or attached to the base 4, there is an opening or void between the left cushion 6 and the right cushion 8 of preferably approximately 5.0" as shown in FIG. 1. By means of the cushion fastener 18 and the base fastener 16 on the base 4, the user may adjustably configure the cushions 6, 8 in an infinite multiplicity of mated relation positions with the base 4 to a position that is most beneficial and comfortable for the user.

The therapeutic seat cushion 2 of the present invention may be made to any length, width and height dimensions desirable for a user. Although a preferred standard size is approximately 16.0" wide by approximately 16.0" long for the base 4, the base 4 may be made in desired width or length dimensions. Preferably, the base back 28 edge is contoured or outwardly rounded as shown in FIG. 1 and FIG. 2 to accommodate most standard and typical chair seat configurations. For preferred dimensions of the base 4, each of the right hand and left hand edges is approximately 13.25" long and then extends with an upward rounded contour toward the base back 28 edge such that the length of the base 4 along line A-A' is approximately 16.0" with an approximately 3.5" straight edge area at the center of the base back 28 edge. The base front 26 edge is approximately 16.0" straight across. Like the base 4, the cushions 6, 8 may be made in any desired width, length or height dimensions.

The fabric cover for each of the base 4 and cushions 6, 8 may be selected from a choice of colors and types of fabric in accordance with a user's preference or need. Additionally, a non-slip material may be used to construct a bottom side of the base 4 which would contact a seating surface when the therapeutic seat cushion 2 of the present invention is in use. Also, an optional tote bag with a shoulder carrying strap may be constructed for and used with the therapeutic seat cushion 2 for transportation and storage of the therapeutic seat cushion 2.

Figure 7:
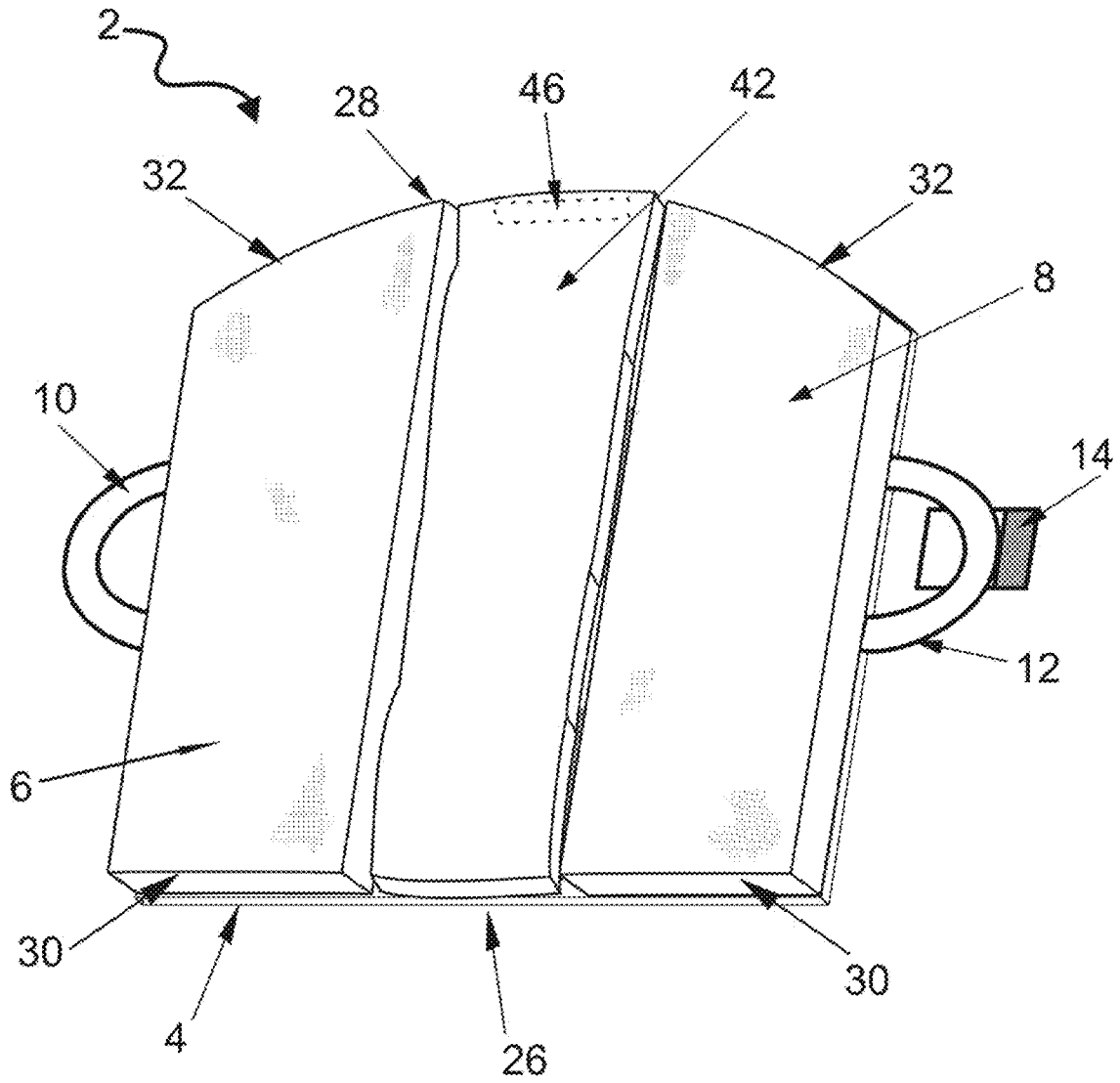
FIG. 7 is a top perspective view of an alternative embodiment of a therapeutic seat cushion of the present invention with an optional pouch for a cold or heat pack.
Figure 8A:
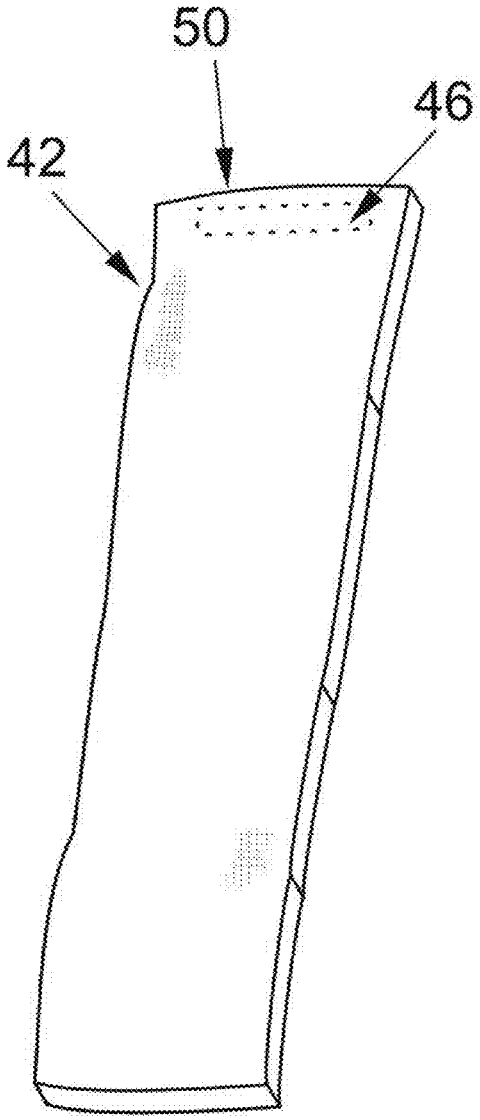
FIG. 8A is a top perspective view of an optional pouch of the therapeutic seat cushion of the present invention.
Figure 8B:
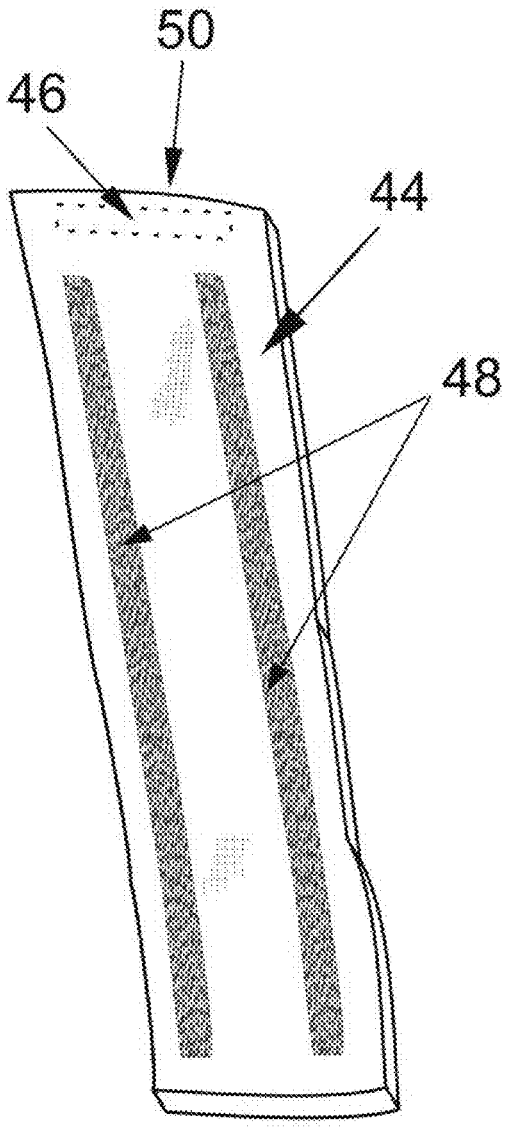
FIG. 8B is a bottom perspective view of an optional pouch of the therapeutic seat cushion of the present invention.

In an alternative embodiment, as shown in FIG. 7, the therapeutic seat cushion 2 of the present invention may have an optional pouch 42 for insertion of a cold or heat pack to be used in conjunction with the therapeutic seat cushion 2. With reference to FIG. 8A and FIG. 8B, the pouch 42 has a pouch opening 50 therein for insertion of a cold or heat pack into the pouch 42. The pouch opening 50 may be closed by means of pouch closure 46. The pouch closure 46 may be constructed of any suitable fastener means, such as, preferably, hook and loop tape, snaps, zippers, hooks and eyes, and the like. The pouch 42 is removably attachable to and detachable from the base 4 by means of pouch fastener 48 which is secured to a pouch backside 44. The pouch fastener 48 may be constructed of any suitable fastener means, such as, preferably, hook and loop tape, snaps, zippers, hooks and eyes and the like. If the pouch fastener 48 is a hook portion of hook and loop tape, then the pouch 42 may be readily removably attached to base fastener 16 by means of the pouch fastener 48. Although the pouch 42 is shown in FIG. 7 with the pouch closure 46 aligned with the base back 28, the pouch closure 46 may also be aligned with the base front 26.

Although the present invention has been described with reference to specific embodiments, it is understood that modifications and variations of the present invention are possible without departing from the scope of the invention, which is defined by the claims set forth below.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

The invention claimed is:

1. A therapeutic seat cushion comprising:

a. A base, wherein the base is shaped essentially as a modified square with an outward rounded side at a base back; further wherein at least a strip of base fastener is attached to a top side of the base in perpendicular relation to line A-A';

b. At least two cushions, wherein the cushions, in mated relation with the base, mirror the shape of the base; further wherein a cushion fastener is attached to a bottom side of the cushion in longitudinal relation from a cushion front edge to a cushion back edge; further wherein when the cushions are in mated relation with the base, there is a void of approximately 5.0" between the cushions; further wherein the void provides an area of the therapeutic seat cushion that does not contact a user's body; and c. A pouch that is removably attachable to the base by means of pouch fastener secured to a pouch backside; wherein the pouch is for insertion of a cold or heat pack;

wherein the cushions are removably attachable to and adjustably configurable on the base by means of the cushion fastener in mated relation with the base fastener; further wherein a purpose of the therapeutic seat cushion is to alleviate pain when sitting; and further wherein the base may be folded along line A-A' and closed.

2. A therapeutic seat cushion comprising:

a. A base, wherein the base is shaped essentially as a modified square with an outward rounded side at a base back; further wherein at least a strip of base fastener is attached to a top side of the base in perpendicular relation to line A-A';

b. At least two cushions, wherein the cushions, in mated relation with the base, mirror the shape of the base; further wherein a cushion fastener is attached to a bottom side of the cushion in longitudinal relation from a cushion front edge to a cushion back edge; further wherein when the cushions are in mated relation with the base, there is a void of approximately 5.0" between the cushions; further wherein the void provides an area of the therapeutic seat cushion that does not contact a user's body; and c. Handles integral with the base; wherein when the therapeutic seat cushion is folded along line A-A' the handles pair and may be mated together with a handle closure;

wherein the cushions are removably attachable to and adjustably configurable on the base by means of the cushion fastener in mated relation with the base fastener; further wherein a purpose of the therapeutic seat cushion is to alleviate pain when sitting; and further wherein the base may be folded along line A-A' and closed.

3. A therapeutic seat cushion comprising:

a. A base having integral handles, wherein the base is shaped essentially as a modified square with an outward rounded side at a base back; further wherein at least a strip of base fastener is attached to a top side of the base in perpendicular relation to line A-A'; further wherein when the therapeutic seat cushion is folded along line A-A' the handles pair and may be mated together with a handle closure;

b. At least two cushions that are removably attachable to and adjustably configurable on the base, wherein the cushions, in mated relation with the base, mirror the shape of the base; further wherein a cushion fastener is attached to a bottom side of the cushion in longitudinal relation from a cushion front edge to a cushion back edge; further wherein when the cushions are in mated relation with the base, there is a void of approximately 5.0" between the cushions; further wherein the void provides an area of the therapeutic seat cushion that does not contact a user's body; and c. A pouch that is removably attachable to the base by means of pouch fastener secured to a pouch backside; wherein the pouch is for insertion of a cold or heat pack;

wherein the cushions are removably attachable to and adjustably configurable on the base by means of the cushion fastener in mated relation with the base fastener; further wherein a purpose of the therapeutic seat cushion is to alleviate pain when sitting; and further wherein the base may be folded along line A-A' and closed.

* * * * *